US010865091B2

(12) United States Patent
Bhutani et al.

(10) Patent No.: US 10,865,091 B2
(45) Date of Patent: Dec. 15, 2020

(54) BEVERAGE DISPENSER SYSTEMS AND METHODS

(71) Applicant: PepsiCo, Inc., Purchase, NY (US)

(72) Inventors: Gurmeet Singh Bhutani, Haryana (IN); Prashant Deshpande, Haryana (IN)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/282,119

(22) Filed: Feb. 21, 2019

(65) Prior Publication Data

US 2019/0256337 A1 Aug. 22, 2019

(30) Foreign Application Priority Data

Feb. 22, 2018 (IN) ..... 201841006718

(51) Int. Cl.
*B67D 1/04* (2006.01)
*B67D 1/00* (2006.01)

(52) U.S. Cl.
CPC ..... *B67D 1/0406* (2013.01); *B67D 1/0057* (2013.01); *B67D 2210/0006* (2013.01)

(58) Field of Classification Search
CPC ..... B67D 1/0057; B67D 1/0406; B67D 2210/0006
See application file for complete search history.

(56) References Cited

U.S. PATENT DOCUMENTS 5,021,219 A * 6/1991 Rudick ..... B01J 7/02 169/78
5,090,440 A * 2/1992 Ladouceur ..... B08B 9/0323 137/209
5,199,609 A * 4/1993 Ash, Jr. ..... B67D 1/0406 141/114
5,411,179 A 5/1995 Oyler et al.
6,073,811 A * 6/2000 Costea ..... B67D 1/0004 222/183
6,695,177 B2 * 2/2004 Blicher ..... B67D 1/0406 222/396
2004/0226960 A1 * 11/2004 Aguirre ..... B67D 1/0406 222/1

(Continued)

OTHER PUBLICATIONS

International Search Report and Written Opinion issued in International Application No. PCT/US19/18979, dated Apr. 30, 2019.

*Primary Examiner* — J C Jacyna
(74) *Attorney, Agent, or Firm* — Sterne, Kessler, Goldstein & Fox P.L.L.C.

(57) ABSTRACT

A beverage dispensing system is provided, including a main body that includes an interior cavity adapted to receive a beverage container, an adaptor module, and a controlled gas system. The adaptor module is configured to provide fluidic coupling from the beverage container to the controlled gas system, such that a beverage may be dispensed through from a tap connected to the adaptor with the aid of positive gas pressure disposed on a beverage surface within the beverage container. The controlled gas system exerts a positive pressure on a surface of the beverage in the beverage container such that when a tap is opened to dispense the beverage, the relative pressure difference between the positive pressure on the surface of the beverage and the ambient pressure causes the beverage to be dispensed from the tap.

17 Claims, 8 Drawing Sheets

(56) References Cited

U.S. PATENT DOCUMENTS

| | | | | |
|---|---|---|---|---|
| 2008/0017045 | A1* | 1/2008 | McGuire | B67D 1/0406 99/323 |
| 2009/0206088 | A1 | 8/2009 | Ogburn | |
| 2014/0103549 | A1 | 4/2014 | Staneland | |
| 2016/0325978 | A1 | 11/2016 | Lehman | |
| 2017/0096323 | A1* | 4/2017 | DeRaedt | B65D 77/068 |

* cited by examiner

BEVERAGE DISPENSER SYSTEMS AND METHODS

FIELD

The described embodiments relate generally to a beverage dispenser. In particular, embodiments relate to a break and pour system utilizing a controlled gas system for aiding dispensing.

BACKGROUND

Various systems and methods for beverage dispensing systems may be used. Beverage dispensing units have become a popular way for food and beverage establishments to create or dispense on-site fountain beverages. Typically, these units include several bag-in-box containers that each contains syrup, a liquid source that dispenses a liquid, a mixing unit, and a dispensing unit. Syrup is pumped from the bag-in-box container into the mixing unit where it is mixed with liquid to form a beverage that is then dispensed through the dispensing unit. Typically, a pump causes the syrup to be released from the bag-in-box container into the mixing unit.

However, in developing and emerging markets, proprietors of markets or road-side stands may not have access to reliable electricity, running water, or refrigeration. In these markets, saleable bottles of beverages (e.g., PET bottles of soft drink, which may be resealable, for example), may be bought by owners of such shops and resold to customers as poured into a cup or glass. In this way, the shop keeper is still able to provide beverages, and the original beverage producer is still gaining sales of saleable units. However, current systems, including manual opening and pouring suffer from slow pouring time, loss of carbonation in carbonated beverages, difficult sanitation in open systems, and other issues described herein. Improved systems and methods are required to overcome these and other issues with prior systems.

SUMMARY

Some embodiments are directed to a beverage dispensing system, including a main body. The main body includes an interior cavity adapted to receive a beverage container therein. The system may further include an adaptor module, and a controlled gas system. In some embodiments, the adaptor module is configured to provide fluidic coupling from a beverage container to the controlled gas system, such that a beverage may be dispensed through from a tap connected to the adaptor with the aid of positive gas pressure disposed on a beverage surface within the beverage container.

In some embodiments, the adaptor module includes an adaptor configured to be coupled to an opening of a beverage container, and a beverage tube coupled to the adaptor and configured to receive beverage from the beverage container.

In some embodiments, the system includes a lid configured to close the interior cavity. The controlled gas system may include a one-way gas valve including a switch configured such that the controlled gas system is limited, or prevented from flowing gas to the beverage container when the lid is removed from the main body. In some embodiments, the controlled gas system includes a gas canister containing one of CO2 or compressed air, for example. In some embodiments a gas line connects the gas canister to a one-way gas valve, and a second gas line connects the one-way gas valve to a manifold. In some embodiments, the manifold connects to the adaptor and allows fluidic communication between the gas canister and the beverage container. In some embodiments, an adaptor is configured to be coupled to the beverage container and configured to provide a gas flow path between the gas canister the beverage container.

In some embodiments, the controlled gas system exerts a positive pressure on a surface of the beverage in the beverage container such that when a tap is opened to dispense the beverage, the relative pressure difference between the positive pressure on the surface of the beverage and the ambient pressure causes the beverage to be dispensed from the tap. In some embodiments, the beverage container is a bottle.

In some embodiments, the system includes a manifold configured to establish a gas flow path between the gas canister and an inside of a beverage container, and configured to establish a beverage flow path between the beverage container and a tap to dispense the beverage. In some embodiments, the system includes a locking member connected to the manifold and configured to retain the adaptor such that the adaptor is coupled to the manifold. In some embodiments, the manifold further includes a gas outlet configured to be coupled to a gas inlet of the adaptor; and a beverage inlet, configured to be coupled to a beverage outlet of the adaptor.

In some embodiments, the controlled gas system exerts a positive pressure on a surface of the beverage inside the beverage container of between about 10 pounds per square inch ("psi") and about 15 psi. In some embodiments, the system further includes a second adaptor module, wherein the second adaptor module is configured to provide fluidic coupling from a second beverage container to the controlled gas system, such that a second beverage may be dispensed through from a second tap connected to the second adaptor with the aid of positive gas pressure disposed on a beverage surface within the second beverage container.

Some embodiments are directed to a break and pour beverage dispensing system including a product restriction element. The product restriction element may include a base profile disposed on an interior surface of a main body of a beverage dispenser. In some embodiments, the base profile is contoured to match a profile of a specific brand's beverage container.

In some embodiments, the system includes a locking member configured to retain a beverage container within a main body of the system. In some embodiments, the locking member is positioned such that it restricts the height of the beverage container to match a height of a specific brand's beverage container. In some embodiments, the system includes a gas canister, and an adaptor configured to be coupled to the beverage container and configured to provide a gas flow path between the gas canister the beverage container.

Some embodiments are directed to a method of dispensing a beverage from a break and pour dispenser. The method may include providing a gas flow path from a gas canister configured to provide fluidic coupling to a gas inlet of an adaptor, providing a beverage flow path from a beverage outlet of the adaptor to a tap, and maintaining a positive pressure in the gas flow path relative to ambient pressure such that when the tap is actuated the pressure in the gas flow path pushes the beverage through the beverage outlet of the tap.

In some embodiments, the method includes providing a one-way gas valve in the gas flow path such that pressure from the gas canister is regulated to flow in one direction towards the gas inlet of the adaptor. In some embodiments, the gas flow path exerts a positive pressure on a surface of the beverage inside the beverage container of between about 10 pounds per square inch ("psi") and about 15 psi.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
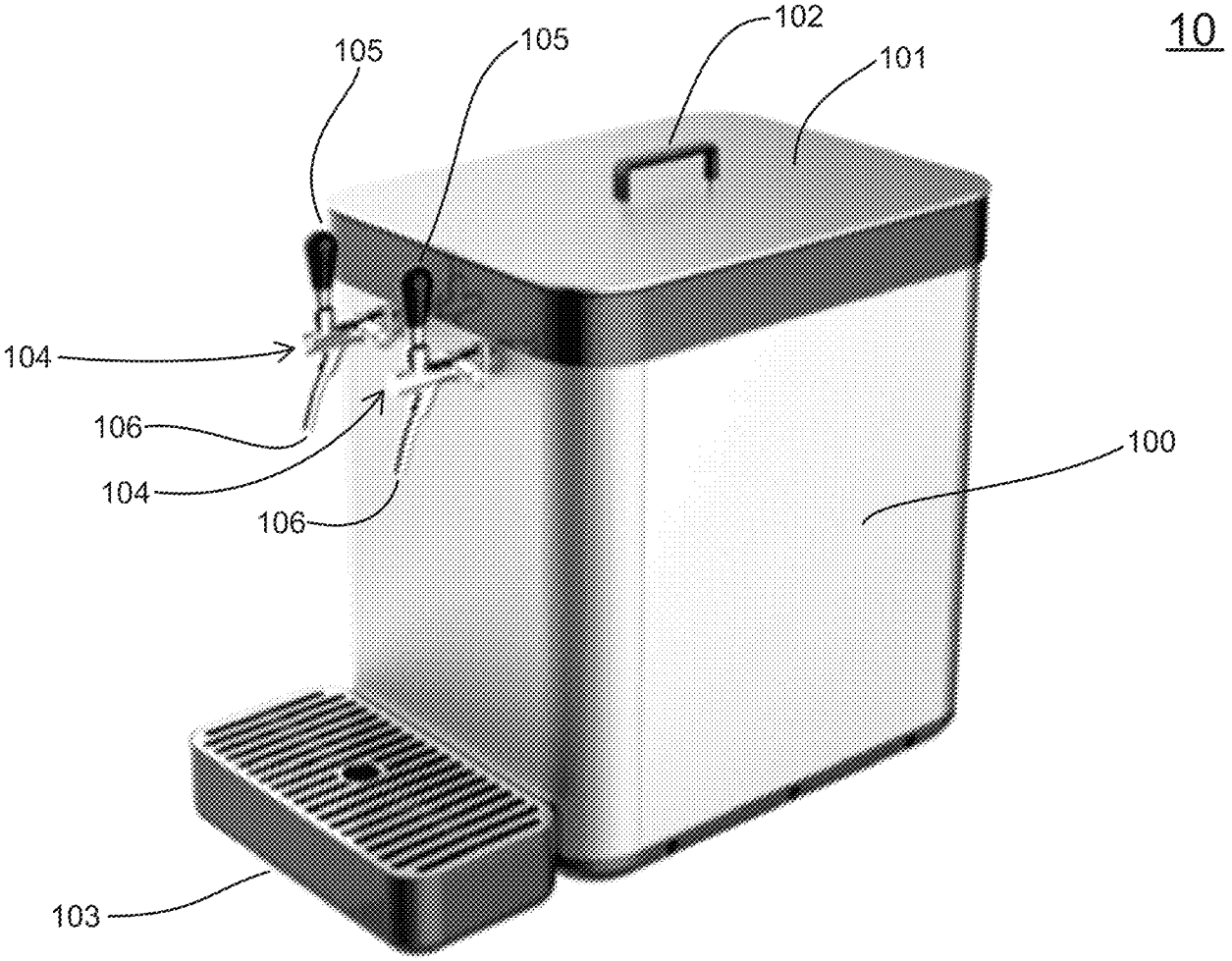
FIG. 1A shows front assembly perspective view of a beverage dispensing system according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As discussed above, beverage dispensing units have become a popular way for food and beverage establishments to create or dispense on-site fountain beverages. Typically, these units include several bag-in-box containers that each contains syrup, a liquid source that dispenses a liquid, a mixing unit, and a dispensing unit. Syrup is pumped from the bag-in-box container into the mixing unit where it is mixed with liquid to form a beverage that is then dispensed through the dispensing unit. Typically, a pump causes the syrup to be released from the bag-in-box container into the mixing unit.

However, in developing nations and pyramid markets, beverages may be poured and served to customers through higher capacity packaged bottles (e.g., 1.25 to 2.25 liter bottles). This process may be referred to as "break-and-pour". Previous methods and systems include, manual breaking and pouring by tilting the bottle by a server, pouring through a particular tap, etc. However, dispensing in these ways have problems associated with them. For example, manual pouring is inefficient and cumbersome for the operator/shopkeeper. Further, if the beverage is a carbonated beverage, these methods tend to decrease the carbonation in them, as air comes in contact with the beverage allows the beverage to lose carbonation. Non-smooth pouring of a carbonated beverage further releases carbonation, and foam may be formed in the glass into which it is poured.

In systems where a bottle is inverted vertically, loss of carbonation is also an issue, as air rushes through the beverage to displace the beverage. While the air is rushing through the beverage, it loses its carbonation and hence consumers complain of a flat drink. Also, a fixed, vertically inverted bottle dispenser has its own challenges of connecting the bottle without spillage. Other systems may be overly complex, leading to difficulty in cleaning the dispenser valve regularly, which is a chore for the operator/shopkeeper. Previous systems and methods do not allow for fast service, leading to an operator having to squeeze the bottle during dispensing for fast pouring, and even then the bottle does not empty completely in many cases.

What is needed is an improved break-and-pour beverage dispensing system, improving upon prior systems, such that an affordable, simple, efficient, fast-pouring, convenient, and ergonomic dispenser is available in developing markets. Embodiments of the systems described herein solve one or more of these problems, and decrease spillage and improve carbonation retention, in part to their novel control gas systems, and bottle lock systems. These systems are fully applicable to non-carbonated beverages. The systems disclosed generally are low-service required. Moreover, do-it-yourself installation and no training being required are achieved through the disclosed systems.

In some embodiments, the beverage container may be a single serve package and can be provided to the consumer from a store attendant. In other embodiments, the beverage may be dispensed to the consumer through a refrigerated system. In some embodiments, the system may be refrigerated and include an integrated point-of-sale ("POS") payment system that would dispense the beverage requiring very little to no interaction from a store attendant, aside from re loading a beverage container and periodic cleaning of the valves.

These and other embodiments are discussed below with reference to the figures. However, those skilled in the art will readily appreciate that the detailed description given herein with respect to these figures is for explanatory purposes only and should not be construed as limiting.

Figure 1B:
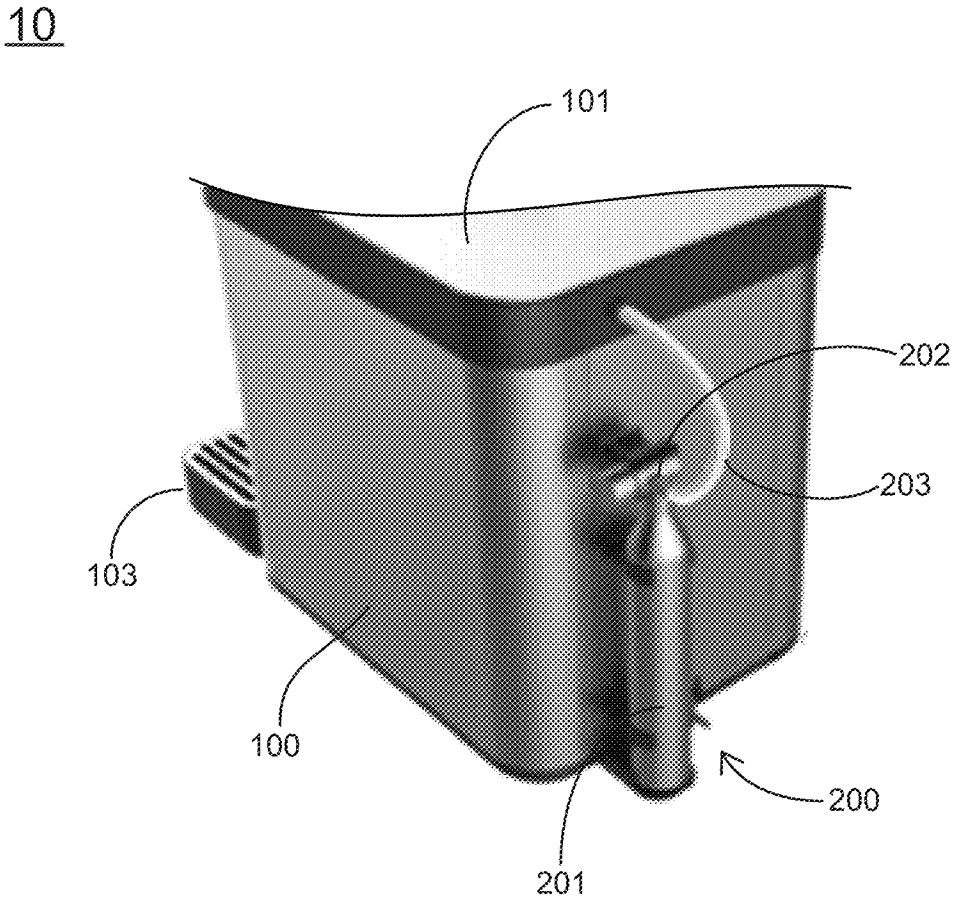
FIG. 1B shows rear assembly perspective view of the beverage dispensing system of FIG. 1A.
Figure 1C:
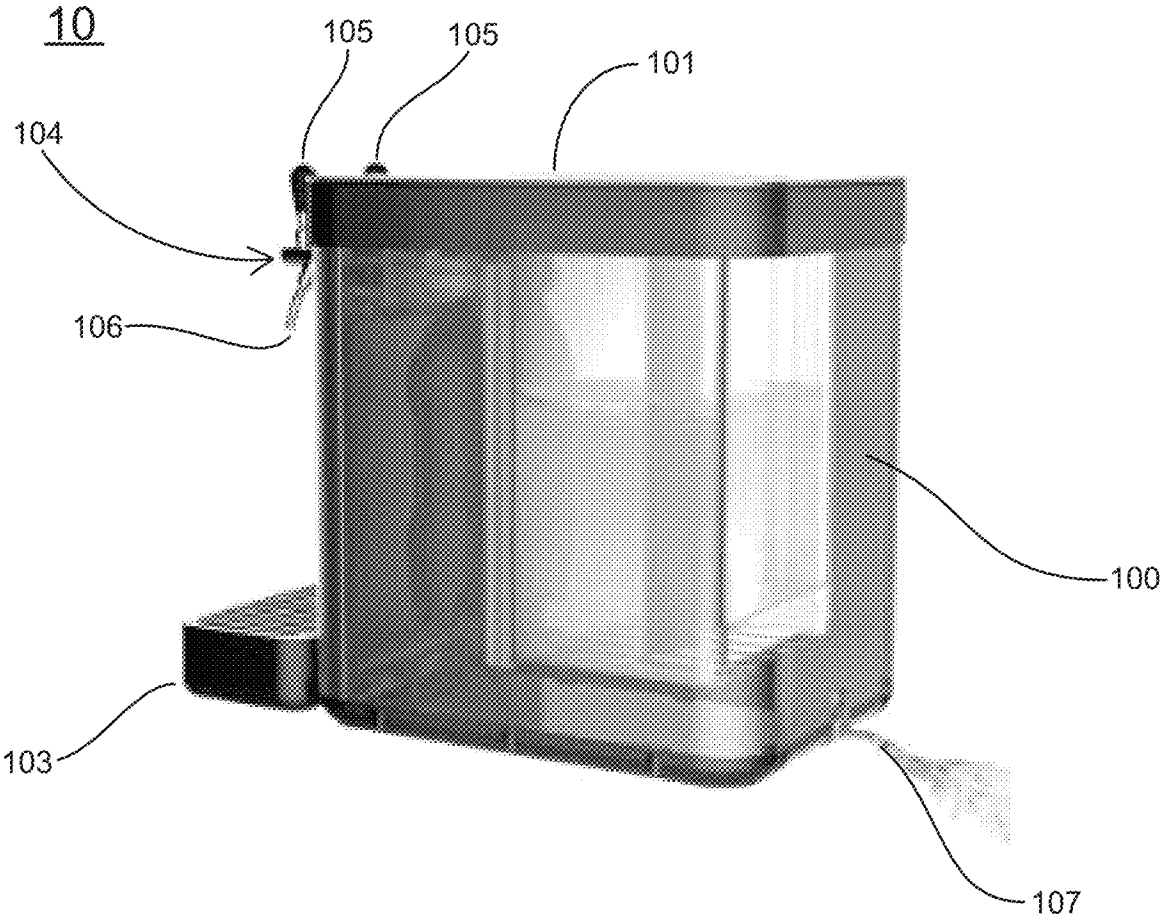
FIG. 1C shows a rear assembly perspective view of the beverage dispensing system of FIG. 1A and FIG. 1B, showing a portion of outer housing removed.

Referring to FIGS. 1A-1C, a beverage dispensing system 10 may include a main body 100. Beverage dispensing system 10 may include a drip tray 103, disposed underneath one or more valves 104. As shown valves 104 include handle 105, and outlet 106. In some embodiments, valves 104 may be self-tapping taps. In order to dispense the beverage, an individual may actually valve handle 105, thereby allowing beverage to flow out of outlet 106. Main body 100 may include a cavity which is enclosed wholly or partially by lid 101, which may include a lid handle 102.

Main body 100 may be configured as a plastic body, which advantageously allows for a portable and rugged installation, for example in use at roadside stands in developing and emerging markets. In some embodiments, the walls of main body 100 and lid 101 may be made from plastic for example, and may include an insulation material, such as polyurethane. In some embodiments one or more of the components may include stainless steel skin, such that the looks of stainless steel is achieved without increasing cost manufacturing issues by making compliance only out of stainless steel. Main body 100 may be configured as a housing to house internal components of the system.

Turning to FIG. 1B, beverage dispensing system then may include a controlled gas system 200. Controlled gas system 200 may include for example, carbon dioxide (CO2) or compressed air. Other food safe gases are also contemplated. As shown in figures controlled gas system 200 may include a gas canister 201 coupled to a regulator 202. Regulator 202 may be coupled to gas line 203 for example, which may run from the regulator through a wall of the beverage dispensing system main body 100, or lid 101. In some embodiments, regulator 202 may be a micro regulator. Regulator 202 may restrict the pressure supplied to gas line 203, for example between about 0 pounds per square inch ("psi") and about 30 psi, more preferably between about 10 psi and about 15 psi. Gas canister 201 may stand alone, apart from main body 100, may be connected to main body 100, e.g. through a support stand or other locating mechanism.

As shown in FIG. 1C, on the interior of beverage dispensing system 10, within a cavity of main body 100, an ice container may be disposed in order to keep interior main body 100 cool. In some embodiments, if an ice container is provided it may be removable. If an ice container is provided, in some embodiments, it may be shaped such that one or more walls are contoured to partially or wholly encircle a beverage container such as a bottle. As the ice melts, fluid exit 107 is configured to allow melted ice exit main body 100. Fluid exit 107 may be connected, for example, to an extension hose such that melted ice, condensation, or other fluid may be diverted further away from beverage dispensing system 10. In some embodiments, fluid exit 107 may include an on/off valve, configured to allow an individual to control drainage of melted ice or water from main body 100.

In embodiments of the beverage dispensing system 10 that include a different cooling system (for example a vapor compression refrigeration system, thermoelectric system, or the like), no ice container is required, and fluid exit 107 may be omitted, or simply capped off. In order to keep the interior of main body 100 cool, the walls and lid of beverage dispensing system 10 may include insulative material.

Figure 2:
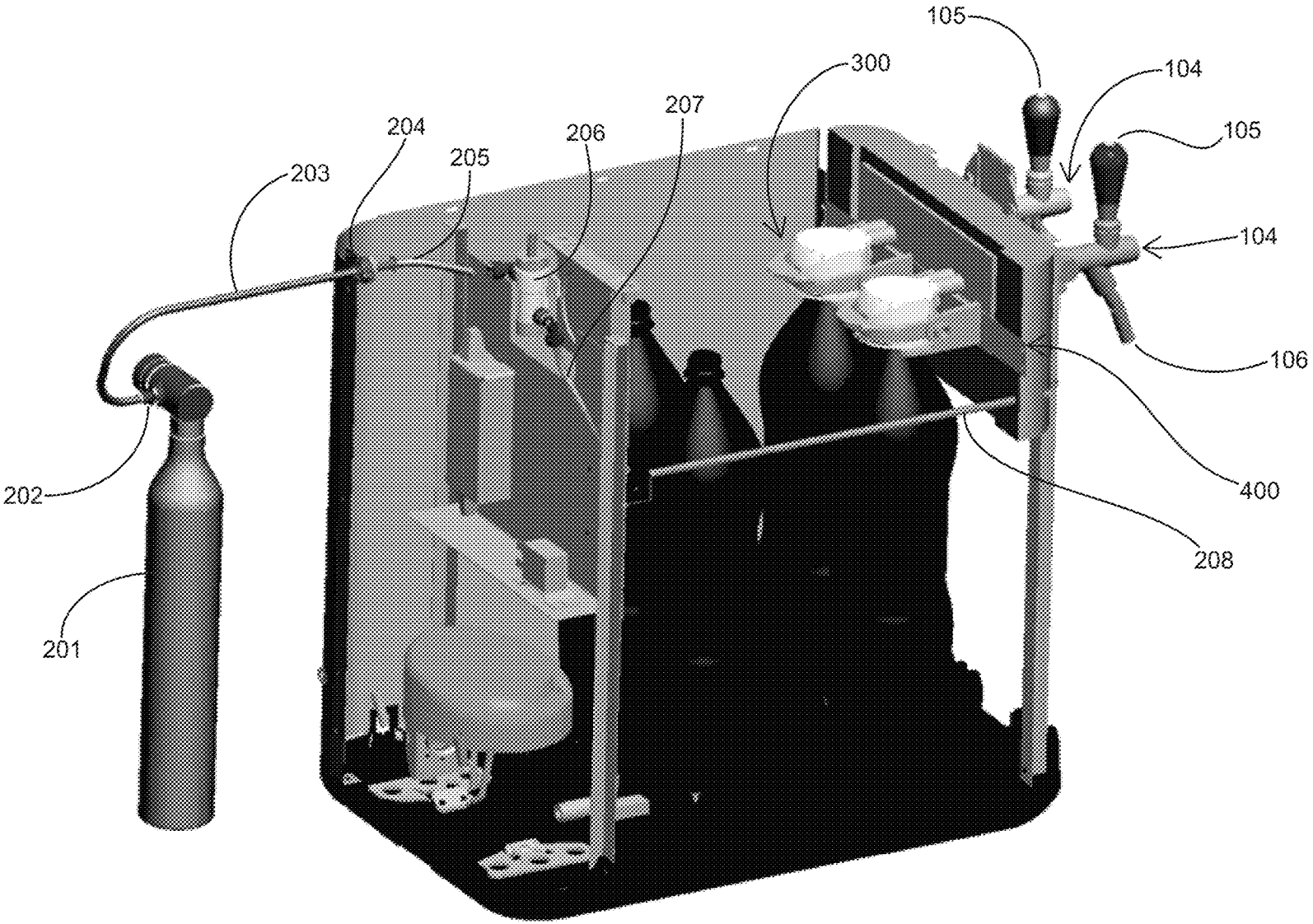
FIG. 2 shows a partially exploded assembly perspective view of the beverage dispensing system shown in FIGS. 1A-1C, including a beverage container.

Turning to FIG. 2, a partially exploded assembly perspective view of the beverage dispensing system shown in FIGS. 1A-1C, including a beverage container is shown. As shown, gas canister 201 is coupled to a regulator 202. Regulator 202 is then coupled to gas line 203 which may run from the regulator through a wall of the beverage dispensing system main body 100, or lid. Gas line 203 may connect to a quick connect 204, which connects to internal gas line 205. One or more quick connects and or frame components, may be provided for installation purposes inside main body 100. Internal gas line 205 may then connect, for example, to a one-way gas valve 206 as shown in the figure. One-way gas valve 206 acts as a check valve, and allows gas to flow only in the direction of the eventual manifold and beverage containers, as further described below. In some embodiments, the one-way gas valve ensures that gas (e.g., CO2 or compressed air, for example) is not introduced into the bottles until lid 101 is secured over the opening in main body 100, through interaction of the lid 101 actuating switch to allow one-way gas valves 206 to open. This way, when lid 101 is removed, no additional gas from gas canister 201 will be introduced past one-way gas valve 206. This switch/valve combination acts in part as a safety feature to avoid unwanted pressure relief when lid 101 is open, such as to change beverage containers when they are empty.

As shown, one-way gas valve 206 leads to one or more additional internal gas lines 207/208 eventually connecting to manifold 400. Suitable framing and support for gas find 207/208 are provided within main body 100. Manifold 400 allows for connection of adaptor module 300, which allows beverage from the beverage containers to be dispensed from valves 104 with the aid of controlled gas system 200. Because controlled gas system provides positive pressure above ambient at a sufficient level, when a tap is opened, the pressure differential causes beverage from the beverage container to be dispensed when the system is opened via the tap. Further discussion of adaptor module 300 with reference to FIG. 3 is now provided.

Figure 3:
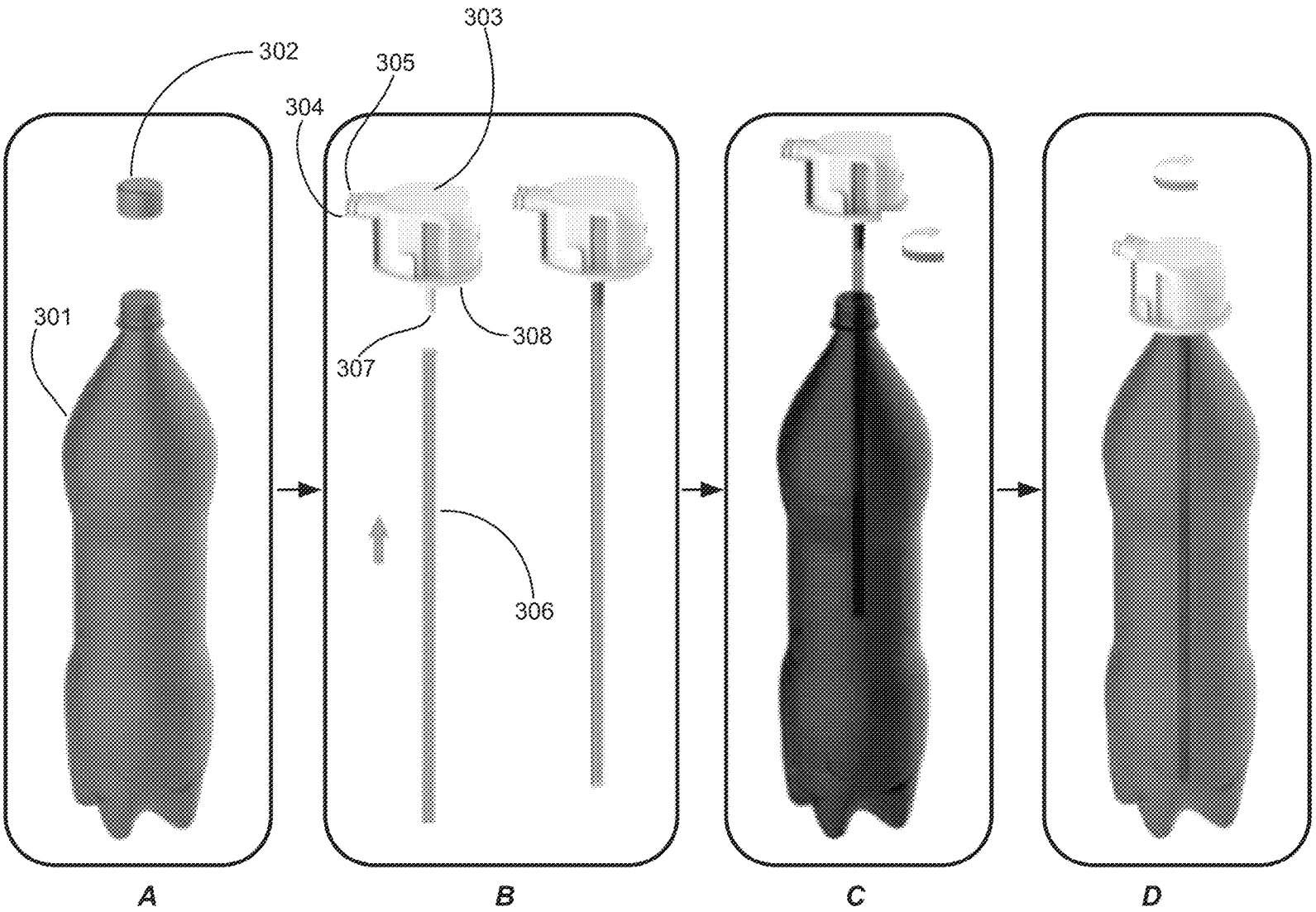
FIG. 3 shows configurations of a beverage container and the connection of a beverage container adaptor according to an embodiment.

As shown in FIG. 3, configurations of adaptor module 300, including how it connects to beverage container 301 are shown. In configuration A, on the left side of FIG. 3, beverage container 301 is shown, with a schematic arrow indicating cap 302 is removed. In some embodiments, beverage container 301 may be a saleable bottle, e.g., a PET bottle of a soft drink, which may be either carbonated or noncarbonated. In some embodiments, an operator may remove a cap 302 on beverage container 301, in order to couple beverage container 301 to adaptor 303. In some embodiments, system 10 may instead puncture beverage container, for example through a puncturing device within adaptor 303.

In some embodiments, the beverage container is a bottle. In some embodiments, the adaptor 300 may be coupled to an opening of a beverage container 301 in a first loading configuration, and positioned in a second beverage dispensing configuration, such that the opening of the beverage container in the second beverage dispensing configuration is positioned at an angle off vertical. This configuration would decrease the vertical footprint of the system 10

As shown in FIG. 2, for example, in some embodiments, the system includes a second adaptor module 300, configured to connect to a second beverage container 301 including a second beverage to be dispensed. In some embodiments, second adaptor module 300 and includes a corresponding second valve 104, mirroring the first dispensing components mentioned above. This may allow for multiple different beverages to be dispensed without changing the configuration of the system 10. In some embodiments, the same beverage may be configured to be dispensed, or different beverages may be configured to be dispensed.

As shown in FIG. 2 for example, in some embodiments, a plurality of beverage containers may be disposed in the interior of main body 100, either in inventory, being cooled on the inside of main body 100 or connected to allow beverage to be dispensed from them. In some embodiments, beverage containers that are connected to the system to be dispensed from may be partitioned from beverage containers not currently connected to the system for dispensing e.g. with further insulating walls for example. In some embodiments, multiple valves 104 and adaptors modules 300 may be connected to beverage containers 301 behind a counter, for example, and when a customer wishes to have a particular beverage, the beverage container coupled to the valve 104 via adaptor module 300 may be obtained, and dispensed into a cup or glass.

As shown in FIG. 3, configuration B shows adaptor 303, connecting to beverage tube 306, via adaptor inlet 307. As shown in configuration B, adaptor 303 includes manifold gas inlet 304 and beverage outlet 305. Once adaptor 303 is connected to beverage tube 306, beverage tube 306 may be inserted into open beverage container 301 and extends into the beverage container 301, and adaptor 303 may cap beverage container 301, as shown in configuration C. In some embodiments, adaptor 303 may include the same internal threading as cap 301, such that is threaded the same way onto beverage container 301. Adaptor 303 may be variable, such that it may be adjustable to fit various beverage containers 301 that may have different bottle openings, thread sizes, or the like. Length of beverage tube 306 may be optimized to provide fluidic communication between the inside of beverage container 301 and adaptor 303. For example, adaptor 303 may include inserts, or include a flexible portion to account for variation in beverage container threads. In some embodiments adaptor 303 may include a quick connect type fluid connection, or other suitable fluid tight seal. In other embodiments, adaptor 303 may be press fit onto the beverage container 301 opening, with an acceptable sealing element. The assembly of beverage container 301 into adaptor module 300, via adaptor 303 is shown in configuration D. A seal may be configured between adaptor 303 and beverage container 301 to ensure a good seal and minimize leakage at the inlet portion when system 10 is in use.

Figure 4:
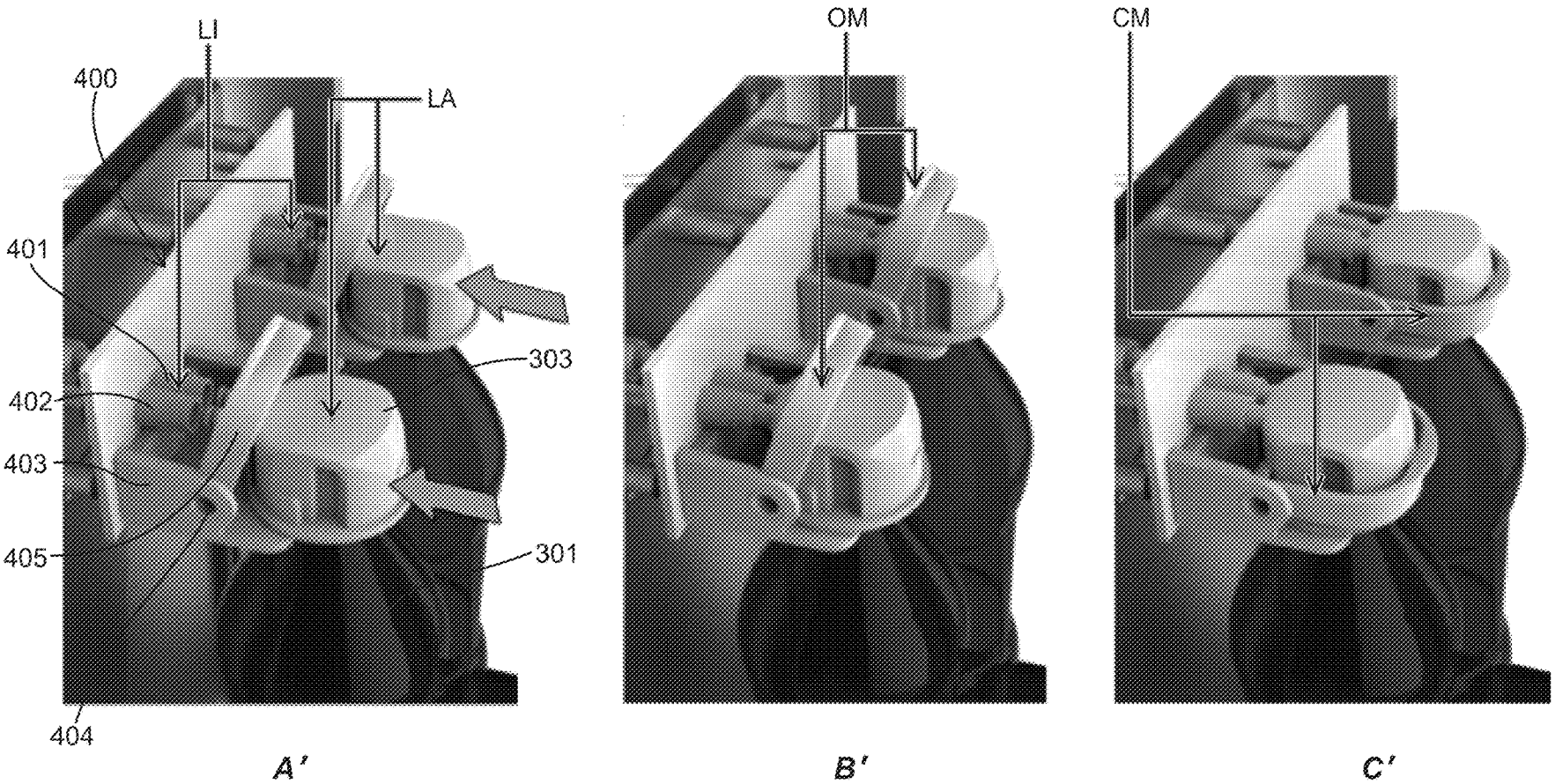
FIG. 4 shows configurations of a locking mechanism connecting beverage container adaptor to a manifold according to an embodiment.

Turning now to FIG. 4, connection of adaptor module 300 to manifold 400 is described. Adaptor 303, coupled to beverage container 301 allows communication between controlled gas system 200 and interior of beverage container 301, through manifold 400. Manifold 400 includes passageways internally to facilitate the flow of gas from controlled gas system 200, and beverage from adaptor module 300. As shown, manifold 400 includes gas outlet 401 and beverage inlet 402. Each of gas outlet 401 and beverage inlet 402 couple to adaptor 303, respectively, to gas inlet 304 and beverage outlet 305. In this way, fluid communication is achieved between the beverage and beverage container 301, and controlled gas system 200. Controlled gas system 200 provides a controlled positive pressure to manifold gas inlet 304 through the regulator, one-way gas valve, and the various gas lines. This positive pressure enters beverage container 301 through adaptor 303, and effectively provides pressure to the fluid surface of the beverage within beverage container 301. In part due to this positive pressure, the beverage may be pushed through beverage tube 306 near the bottom of beverage container 301, and exit the adaptor module 300 through beverage outlet 305.

As shown in FIG. 4, in configuration A', the adaptor module 300 coupled with the beverage container 301 may be placed close to manifold 400, and slid forward, positioning gas inlet 304 and beverage outlet 305 (together a locking adaptor "LA") toward gas outlet 401 and beverage inlet 402 (together a locking interface "LI"). In this way, gas outlet 401 may be coupled to gas inlet 304; and beverage inlet 402 may be coupled to beverage outlet 305. Adaptor module may have flanges or other locating features that may engage one or more surfaces of manifold 400, locating the two components with respect to one another. Once adaptor module 300 is slid into place, it may be locked in place, for example with a hinge mechanism. An example of such mechanism is shown in FIG. 4. Extension member 403 may be mounted to manifold 400, fixing it in place. Extension member 403 may extend from manifold 400, and may attach to locking member 405 via a pin connection 404. In this respect, locking member 405 may pivot about the pin connection 404, and partially or wholly enclose adaptor 303.

As shown in FIG. 4, in configuration B', the adaptor module 300 is shown coupled to manifold 400, with locking member 405 in an open configuration ("OM"). In order to secure adaptor module 300 to manifold 400, locking member 405 may be rotated to a closed configuration ("CM"), for example as shown in configuration C'. In the closed configuration, beverage dispensing system 10 is ready to use. In some embodiments, beverage dispensing system 10 may require locking member 405 to be in the closed configuration prior to dispensing a beverage from one of the valves. In some embodiments, if there are plural adaptor modules 300, each with a corresponding locking member 405, only those adaptor modules 300 which are desired to dispensed beverages from may be required to have their respective locking member 405 in a closed configuration.

Figure 5:
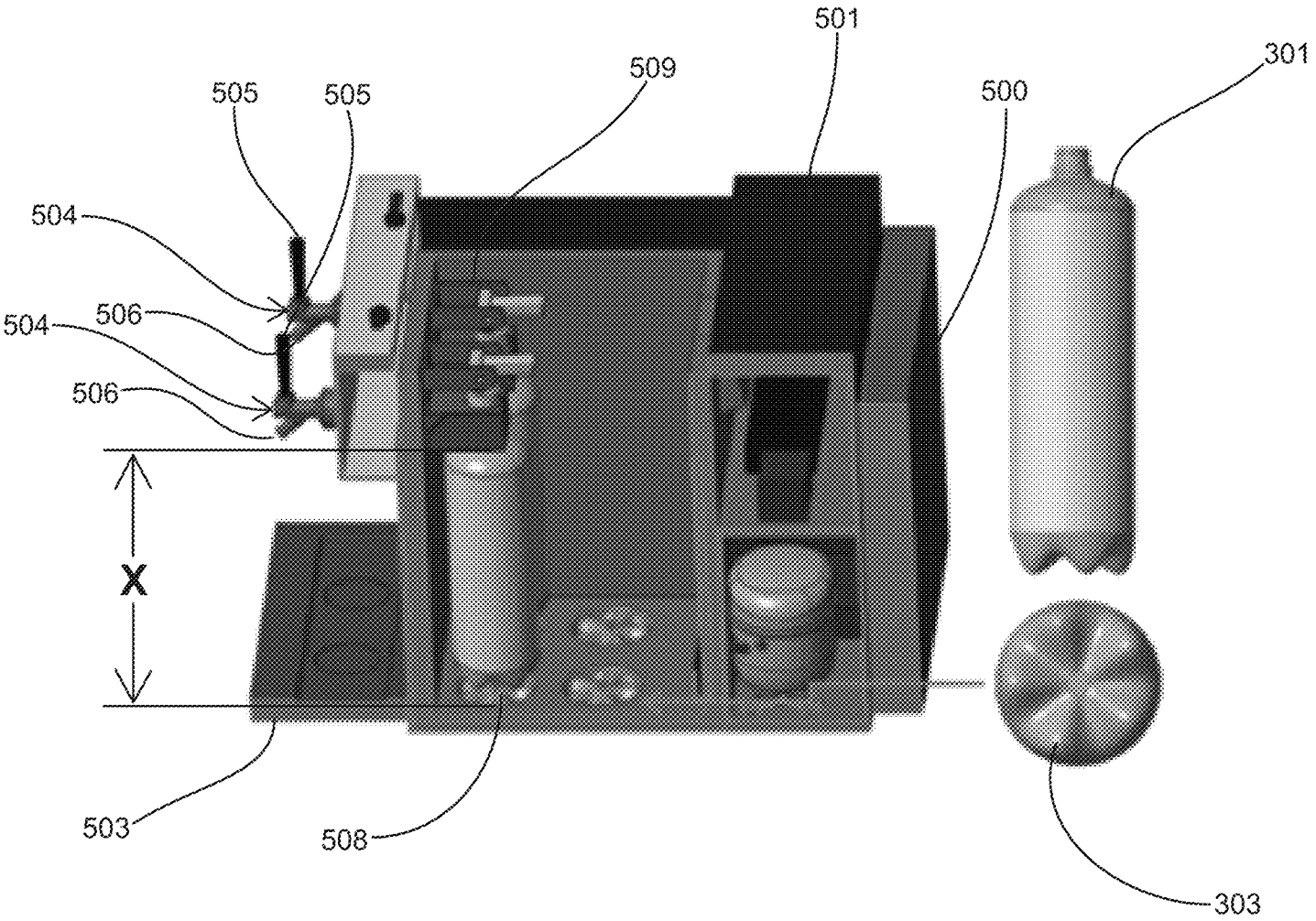
FIG. 5 shows partial exploded view of a beverage dispensing system having a beverage validation system according to an embodiment.

Turning to FIG. 5, an embodiment of beverage dispensing system 10 is shown, including a product restriction element. Beverage dispensing system 10 may include a drip tray 503, disposed underneath one or more valves 504. As shown valves 504 include handle 505, and outlet 506. In some embodiments, valves 504 may be self-tapping taps. In order to dispense the beverage, an individual may actually valve handle 505, thereby allowing beverage to flow out of outlet 506.

A product restriction element may include for example, one or more of a base profile 508, or height device 509. As shown in the figure, base profile 508 is contoured to match a profile 303 of the particular beverage container 301. In practice the profiles 303, formed on the bottom of a particular brand beverage container 301, may be standardized for a given brand, but may differ from profiles of competitor beverage containers. By specifically providing that base profile 508 is contoured to match a specific profile 303, of a particular brand beverage containers 301, a consumer may be protected from purchasing a different beverage than the beverage that may be advertised, for example on an outer surface of main body 100.

Additionally, height device 509 may interact with manifold 400, having locking member 405, such that a beverage container 301 height is controlled. Similar to the base profiles, the height of particular brands beverage containers may vary, but for a given brand or manufacturer may be standardized. Again, this protects the consumer from purchasing a different beverage than the beverage they expect to be purchasing.

Figure 6:
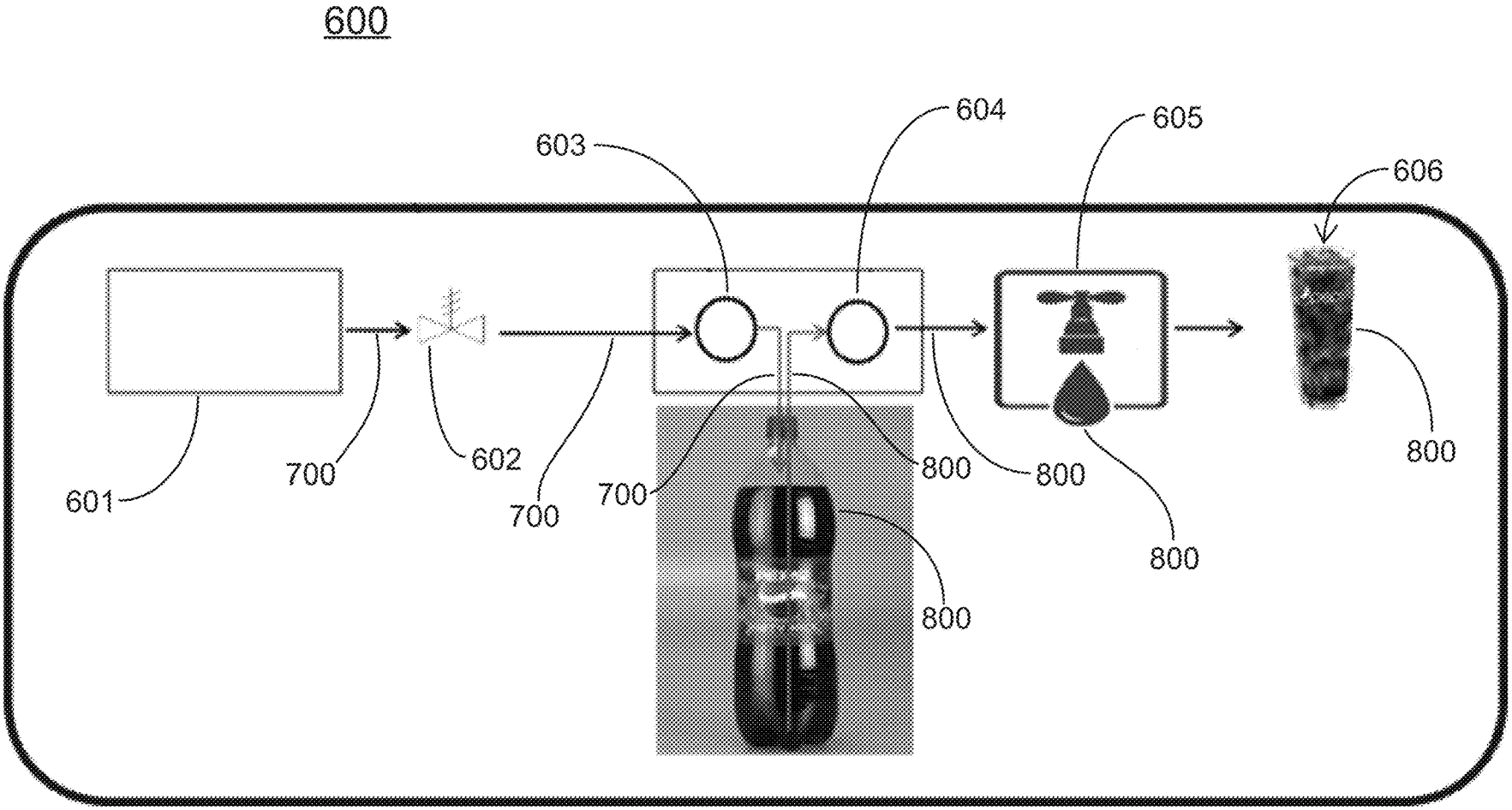
FIG. 6 shows a schematic view of a beverage dispensing system according to an embodiment.

Turning to FIG. 6, a schematic view of a beverage dispensing system 600 is shown. As shown, gas canister 601 (which may include a regulator) allows gas to pass through one-way valve 602. The gas flow path is denoted by element number 700. As shown gas 700 flows through one-way valve 602, and into the inlet 603 of the adaptor. Inside the adaptor, gas 700 flows into the open space above the surface of beverage 800. During operation positive pressure 700 exerts on the fluid surface of beverage 800 inside the bottle pushes beverage 800 into the adaptor and out outlet 604. Beverage 800 and flows into valve body 605 which may be actuated dispense the beverage 800 into a glass 606. The gas is maintained at equilibrium pressure when valve body 605 is closed.

Once the valve body 605 is activated by moving the dispensing valve handle 105 as described above, the gas exerts pressure on the beverage head inside the bottle, because opening valve handle 105 opens the one-way system to ambient pressure and disturbs equilibrium. This opens the system, such that the beverage within the bottle displaces towards the lower pressure path, through the outlet of dispensing valve body 605. The controlled pressure of the gas flow path 700 allows the individual greater flexibility and control dispensing the beverage, as compared to other methods such as gravity feed, mechanical squeezing of the bottle, etc. In some embodiments, due to the manifold feature described herein, gas flow path 700 is connected to an additional gas flow path 700 such that pressure coming from the gas in gas canister 601 is maintained at the same value, independent of which gas flow path 700 a bottle is connected to.

Advantageously for carbonated beverages, the gas in gas flow path 700 is maintained at pressure higher than atmospheric pressure enabling retention of dissolved CO2 in the carbonated beverage, which ultimately maintains the beverage carbonation essential for the beverage taste quality. Relatedly, by providing a pressure regulator to control gas pressure provided into the bottles (e.g., between about 10 psi to 15 psi, for example) flow and froth volume (e.g., bubbles, or head) in a dispensed beverage. Additional control may be achieved by using a ball valve inside dispensing valve. If CO2 is used as the gas, this improves cleanliness of the system, because CO2 acts as a disinfectant. This decreases the maintenance required overall for beverage dispensing system 10.

Some embodiments are directed to a method of dispensing a beverage from a break and pour dispenser. The method may include providing a gas flow path from a gas canister configured to provide fluidic coupling to a gas inlet of an adaptor, providing a beverage flow path from a beverage outlet of the adaptor to a tap, and maintaining a positive pressure in the gas flow path relative to ambient pressure such that when the tap is actuated the pressure in the gas flow path pushes the beverage through the beverage outlet of the tap.

In some embodiments, the method includes providing a one-way gas valve in the gas flow path such that pressure from the gas canister is regulated to flow in one direction towards the gas inlet of the adaptor. In some embodiments, the gas flow path exerts a positive pressure on a surface of the beverage inside the beverage container of between about 10 pounds per square inch ("psi") and about 15 psi.

As discussed above, in some embodiments, the beverage container may be a single serve package and can be provided to the consumer from a store or restaurant attendant. The beverage container may be a resealable bottle, such as a 1.5 L or 2 L bottle. In other embodiments, the beverage container may be dispensed to the consumer through a vending machine, or stored on a shelf. In some embodiments, the vending machine may be refrigerated and include an integrated point-of-sale ("POS") payment system that would dispense the beverage requiring very little to no interaction from a store attendant.

An individual may remove the lid of the beverage dispensing system, in order to access the cavity inside. Once open, the one-way gas valves shut off further gas from entering the system past the one-way gas valves. In this regard, individual may purchase the remaining gas from the lines past the one-way gas valve safely. Once the remaining gas from the lines past one-way gas valves has safely been purged, any beverage containers e.g., resealable bottles, may be disconnected from the system by removing any locking mechanism from the adaptor connected to the bottles. Once any locking mechanism is disengaged, the adaptor assembly coupled to the bottle may be removed from the interior cavity of the main body of the dispensing system. The adaptor then may be removed from the bottle connected to it and any beverage to may be removed from the interior of the bottle. In order to continue dispensing beverages a fresh beverage container may be opened, the beverage tube inserted into the beverage container, and the adaptor coupled to the beverage container. Once so coupled, the adaptor may be reconnected to the beverage dispensing system, that is, to the manifold in the control gas system. The individual may then replace the lid, actuating a switch that allows the one-way gas valves to engage in fluidic coupling between the gas canister in the rest of the components.

Once the gas canister is connected to the system, the gas flow exerts a positive pressure on a surface of the beverage inside the beverage container. When an individual, such as a customer, wishes to dispense a beverage, they may actuate a valve in the form of a tap and open fluidic communication between the beverage liquid in the beverage container and ambient pressure. Due to the pressure differential provided by positive pressure applied by the gas canister, the beverage liquid in the beverage container is pushed through the system and is dispensed through the tap, for example into a cup or glass.

In some embodiments, the system may be operated entirely by an attendant, rather than the consumer.

The configuration described optimizes the center of gravity balance and integrates an entire beverage dispensing system such that the system 10 is a stable table-top unit. In some embodiments, a support pad may be included, such as a leveling support pad disposed under main body 100 to balance on relatively uneven surfaces.

Features of each embodiment described herein are equally applicable to each other embodiment.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A beverage dispensing system, comprising:

a main body, comprising:

an interior cavity adapted to receive a beverage container therein;

a tap configured to dispense a beverage;

a manifold fixed to a surface of the main body disposed inside the interior cavity;

a controlled gas system fluidly connected to the manifold; and an adaptor module releasably connected to the manifold and releasably coupled to the controlled gas system and the tap through the manifold, wherein the adaptor module is configured to be attached to the beverage container wherein the manifold includes a first surface configured to slidably receive a corresponding second surface on the adaptor module such that the first surface and the second surface are in contact when the adaptor module is fluidly coupled to the controlled gas system and the tap, and wherein the adaptor module is configured to be attached to the beverage container before being coupled to the controlled gas system and the tap and is configured to provide fluidic coupling from the beverage container to the controlled gas system, such that a beverage may be dispensed from the tap with the aid of positive gas pressure disposed on a beverage surface within the beverage container.

2. The system of claim 1, wherein the adaptor module further comprises:

an adaptor configured to be coupled to an opening of a beverage container; and a beverage tube coupled to the adaptor and configured to receive beverage from the beverage container.

3. The system of claim 1, further comprising:

a lid configured to close the interior cavity; and wherein the controlled gas system further comprises:

a one-way gas valve including a switch configured such that the controlled gas system is prevented from flowing gas to the beverage container when the lid is removed from the main body.

4. The system of claim 1, wherein the controlled gas system further comprises:

a gas canister containing one of CO2 or compressed air;

a gas line connecting the gas canister to a one-way gas valve;

a second gas line connecting the one-way gas valve to the manifold, wherein the manifold connects to the adaptor and allows fluidic communication between the gas canister and the beverage container.

5. The system of claim 1, wherein the controlled gas system further comprises:

a gas canister; and wherein the adaptor module further comprises:

an adaptor configured to be coupled to the beverage container and configured to provide a gas flow path between the gas canister and the beverage container.

6. The system of claim 1, wherein the controlled gas system exerts a positive pressure on a surface of the beverage in the beverage container such that when the tap is opened to dispense the beverage, the relative pressure difference between the positive pressure on the surface of the beverage and the ambient pressure causes the beverage to be dispensed from the tap.

7. The system of claim 1, wherein the beverage container is a bottle.

8. The system of claim 1, wherein the manifold is configured to establish a gas flow path between a gas canister and an inside of a beverage container, and configured to establish a beverage flow path between the beverage container and a tap to dispense the beverage.

9. The system of claim 8, further comprising:

a locking member connected to the manifold and configured to retain the adaptor such that the adaptor is coupled to the manifold.

10. The system of claim 9, wherein the manifold further comprises:

a gas outlet configured to be coupled to a gas inlet of the adaptor; and a beverage inlet, configured to be coupled to a beverage outlet of the adaptor.

11. The system of claim 1, wherein the controlled gas system exerts a positive pressure on a surface of the beverage inside the beverage container of between about 10 pounds per square inch ("psi") and about 15 psi.

12. The system of claim 1, further comprising:

a second adaptor module, wherein the second adaptor module is configured to provide fluidic coupling from a second beverage container to the controlled gas system, such that a second beverage may be dispensed through from a second tap connected to the second adaptor with the aid of positive gas pressure disposed on a beverage surface within the second beverage container.

13. The system of claim 1, further comprising:

a product restriction element comprising a base profile disposed on an interior surface of the main body, wherein the base profile is contoured to match a profile of a specific brand's beverage container and to prevent the use of a beverage container with a different base profile in the beverage dispensing system.

14. The system of claim 13, further comprising:

a locking member configured to retain the beverage container within the main body of the system, wherein the locking member is positioned such that it restricts the height of the beverage container to match a height of a specific brand's beverage container.

15. The system of claim 13, wherein the beverage container is a bottle.

16. The system of claim 13, further comprising:

a gas canister; and an adaptor configured to be coupled to the beverage container and configured to provide a gas flow path between the gas canister and the beverage container.

17. The system of claim 16, wherein the gas flow path exerts a positive pressure on a surface of the beverage inside the beverage container of between about 10 pounds per square inch ("psi") and about 15 psi.

* * * * *